United States Patent [19]

Friedlander

[11] 4,112,403

[45] Sep. 5, 1978

[54] SATURATED REACTOR ARRANGEMENTS

[75] Inventor: Erich Siegfried Friedlander, Sutton Coldfield, England

[73] Assignee: Associated Electrical Industries Limited, London, England

[21] Appl. No.: 743,790

[22] Filed: Nov. 22, 1976

[30] Foreign Application Priority Data

Nov. 25, 1975 [GB] United Kingdom ..... 48358/75

[51] Int. Cl.[2] ..... H01F 33/00; G05F 3/06

[52] U.S. Cl. ..... 336/12; 323/50; 323/83; 323/89 C

[58] Field of Search ..... 336/5, 10, 12, 180, 336/184, 155; 363/152, 153, 154; 323/47, 48, 50, 53, 54, 57, 83, 85, 89 C

[56] References Cited

U.S. PATENT DOCUMENTS 2,488,628 11/1949 Hoeppner ..... 336/12 X

FOREIGN PATENT DOCUMENTS 1,194,151 6/1970 United Kingdom ..... 336/12

1,303,634 1/1973 United Kingdom ..... 336/12

OTHER PUBLICATIONS

Friedlander, "Principle and Analysis of Stabilized Phase Multiplier Type of Magnetic Frequency Converter, Electrical Energy", Oct. 1965.

*Primary Examiner*—Thomas J. Kozma

*Attorney, Agent, or Firm*—Kirschstein, Kirschstein, Ottinger & Cobrin

[57] ABSTRACT

A saturated reactor adapted for direct connection to an EHV line and thus constituting a combined reactor and transformer. A problem arises in that earthing of the primary winding star point would normally short circuit the 3rd harmonic. The invention overcomes this by series connection of primary coils coupled to three limbs whose fluxes are spaced at 40°. 3rd harmonic voltages therefore cancel in the series primary windings. The series primary windings may be obtained as separate coils on individual limbs or as one coil (per phase) embracing three limbs. Elimination of the 3rd harmonic enables the ninth harmonic to be short circuited in a mesh winding.

10 Claims, 7 Drawing Figures

SATURATED REACTOR ARRANGEMENTS

This invention relates to saturated reactor arrangements of the kind employed for voltage stabilisation in power supply systems. In such stabilisation applications the essential feature of saturated reactors is their ability to draw a very large range of reactive current in response to a relatively small range of applied voltage, and in addition, to make such a response almost instantaneous.

This inherently low 'slope reactance', i.e. the incremental reactance over the saturated portion of the reactor characteristic, can be artificially reduced even further by the use of a slope correcting series capacitor as described, for example, in U.K. Pat. Specifications Nos. 1381642 and 1413050. However, in some applications, particularly with very long transmission lines, such capacitor correction is not entirely satisfactory in view of transient effects which take a short time to correct. It is therefore desirable to provide, as far as possible, the lowest inherent slope reactance.

Voltage stabilising saturated reactors are normally connected to EHV line systems by EHV transformers. Such transformers entail an increase in overall slope reactance, increased losses and, of course, substantial cost. It would be desirable therefore if they could be obviated. However, if previously proposed reactors were provided with adequate insulation and connected direct to the line there would be difficulties arising from the inability to earth the primary winding directly at the star point, without causing some unacceptable third harmonic current components in the system. These third harmonic current components must also be avoided in the interest of maintaining good linearity of the reactor characteristic and, more particularly, a low content of harmonics in the primary current.

One such reactor is described in U.K. Pat. Specification No. 1194151.

An object of the present invention is therefore to provide a saturated reactor arrangement which lends itself to direct line connection and to earthing of the primary winding.

According to the present invention, a saturated reactor arrangement for use in a voltage stabilising system comprises a reactor core having nine (or any multiple of nine) wound limbs, a symmetrical star-connected primary winding distributed over the nine wound limbs, a set of phase-shifting windings arranged on the nine limbs and interconnected to produce fluxes in the nine limbs of phases uniformly staggered throughout 360°, each arm of the primary star-connected winding embracing three limbs whose flux phases are such as to provide net cancellation of third harmonic voltages in that arm, and a mesh-connected winding coupling said nine limbs to provide a path for the circulation of ninth harmonic current, the arrangement being such that earthing of the star point of said primary winding causes neither third nor ninth harmonic current to flow therein. In a reactor having a multiple of nine limbs the above relationships exist within each set of nine limbs.

The reactor arrangement may thus constitute a combined transformer and voltage stabilising reactor for direct connection to an EHV power system.

The nine limbs may be arranged in groups of three, each group forming one composite leg of a 3-leg reactor, and said primary winding comprising a coil on each said composite leg embracing all three limbs. In this case, the mesh connected winding may also comprise a coil on each composite leg embracing all three limbs.

With this composite leg arrangement there may be three magnetic circuits each comprising three limbs, one limb from each composite leg, and two yokes.

The three limbs of each magnetic circuit may carry fluxes phase displaced by 120°, the three limbs in each composite leg being bridged at both ends by a transverse yoke to permit the circulation of third harmonic flux without having to provide unwound return limbs between the yokes of the individual cores.

Alternatively, the three limbs of each magnetic circuit may carry fluxes phase displaced by 80° or by 160°, to provide a balanced third harmonic system within each said magnetic circuit, one or more unwound return limbs being provided between the yokes in each said magnetic circuit to carry the resulting net fundamental flux.

The mesh connected winding may physically separate the primary winding from the phase-shifting windings and may be adapted to be earthed to provide an earth shield for the primary winding.

The reactor arrangement may comprise nine limbs, similarly disposed between two yokes, the primary winding then comprising, for each of the star connected arms, a coil on each of three limbs, connected in series.

Two embodiments of a reactor arrangement in accordance with the invention wll now be described, by way of example, with reference to the accompanying drawings, of which:

Figure 1:
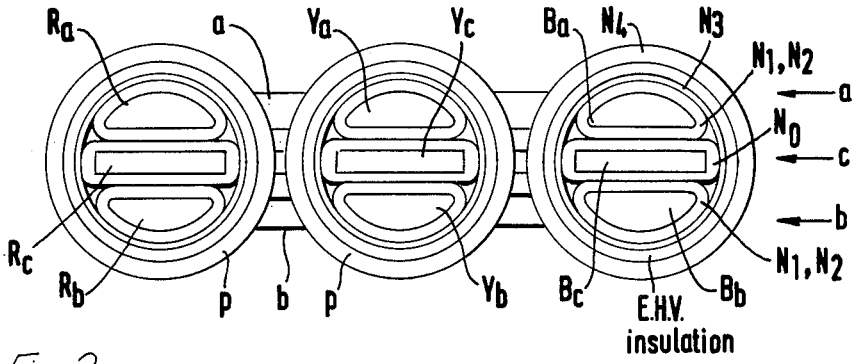
FIGS. 1, 2 and 3 are sectional plan, part elevation and end view of a reactor constituting an EHV transformer.
Figure 2:
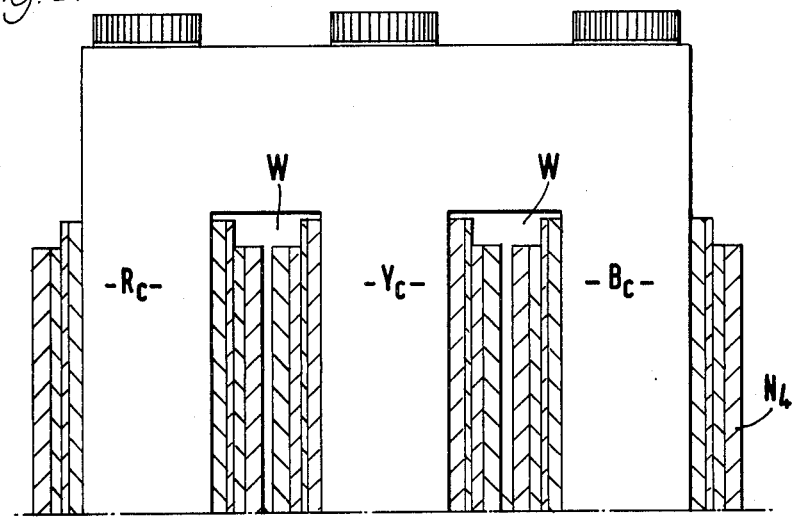

Referring to the drawings, FIG. 1 shows the cross sections of nine limbs referenced $R_a$, $R_b$, $R_c$, $Y_a$, $Y_b$, $Y_c$ and $B_a$, $B_b$ and $B_c$. The 'R' limbs form one composite leg and the Y and B limbs similarly. The '*a*' limbs are bridged by a yoke '*a*' and the '*b*' and '*c*' limbs similarly. The lower ends of the limbs are similarly bridged by yokes '*a*', '*b*' and '*c*'. It will be seen that the whole core comprises, basically, three magnetic circuits superimposed, each being arranged with two windows, as indicated in FIG. 2.

The nine limbs are required to carry fluxes uniformly staggered throughout 360°, that is, spaced at 40°. This is achieved by arranging for the centre limbs $R_c$, $Y_c$ and $B_c$ to have fluxes spaced at 120° and for the '*a*' and '*b*' limb fluxes to be spaced 40° each side of the centre limb flux.

Figure 4:
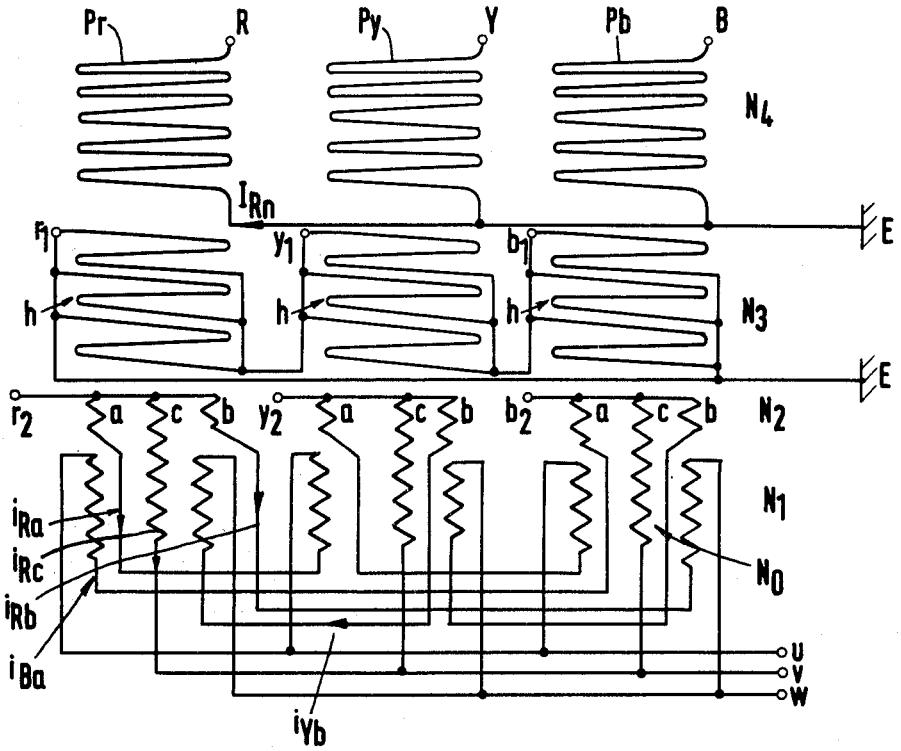
FIG. 4 is a winding diagram for the reactor of FIGS. 1–3.

The winding arrangement to achieve this symmetrical flux distribution is shown in the lower part of FIG. 4. The '*c*' limbs each carry a single winding star-connected to a terminal '*v*' from three terminals $r_2$, $y_2$ and $b_2$. The '*a*' and '*b*' limbs then each carry two windings selected to shift the phase of their fluxes relative to the '*c*' windings. The '*a*' limb windings are star-connected from the terminals $r_2$, $y_2$ and $b_2$ to a terminal '*v*' and the '*b*' limb windings from the same terminals to a terminal '*w*'.

The winding magnitudes are $N_0$ turns on each 'c' limb and $N_2$ and $N_1$ turns for the two windings on each 'a' and 'b' limbs. The 'c' limb winding is used as a reference so that $N_1 = 0.742\ N_0$ and $N_2 = 0.395\ N_0$.

The primary winding of the reactor comprises a coil 'p' on each composite leg, of magnitude $N_4$ turns. Each coil 'p' completely embraces the associated composite leg of the reactor, including all of the windings on that leg and is heavily insulated. The three coils 'p' are star connected between phase terminals R, Y and B and an earth terminal E. In operation the three terminals R, Y and B are connected directly to an EHV transmission system.

A further winding consists of a coil 'h' on each composite leg also embracing the 'a', 'b' and 'c' limbs and their phase-shifting windings. The coils 'h' are mesh-connected between terminals $r_1$, $y_1$ and $b_1$. The mesh is then earthed by connection between the terminal $r_1$ and a further earth terminal E.

The nine saturable limbs are thus symmetrically distributed among the phases and it is known that such an arrangement causes the elimination of harmonic currents in the supply circuit below the $2n - 1$ harmonic, i.e. in this case below the 17th. This phenomenon is explained further in, for example, a paper entitled "Principle and Analysis of a Stabilized Phase Multiplier Type of Magnetic Frequency Convertor" by E. Friedlander in "Electrical Energy", October 1956.

In the present embodiment it has been stated that each composite leg includes three fluxes whose fundamentals are phase displaced by 40°. It will be seen therefore that the third harmonic contents of these fluxes are relatively displaced by 120° thus producing a net zero third harmonic voltage in the primary winding 'p' and in the mesh winding 'h'. It is this feature which permits the star point of the primary winding to be earthed without causing third harmonic earth currents driven by these third harmonic core fluxes. The absence of third harmonic earth currents is essential for achieving the desired characteristic features of the saturated reactor.

Figure 3:
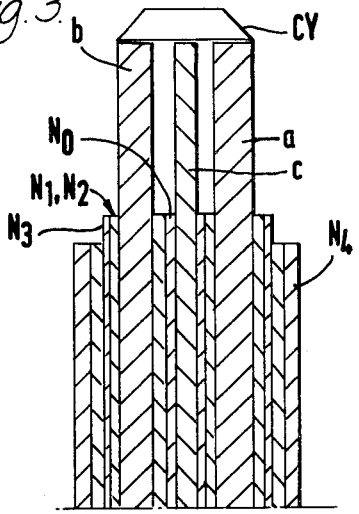

However, the third harmonic flux systems in the three composite legs are in phase (as a result of the 120° fundamental spacing of the 'c' limb fluxes) and, as so far described, there are no return paths for the three parallel systems. Cross yokes CY, shown in FIGS. 2 and 3, are therefore provided at both ends of each composite leg to complete the local third harmonic flux paths. Sufficient insulation between these cross yokes and the main 'a', 'b' and 'c' yokes is provided to prevent circulating core currents.

The elimination of third harmonic currents other than in the phase-shifting windings permits the above mentioned mesh-connected coils 'h' to be employed as a short-circuit for ninth-harmonic currents with no fear of short circuiting the third harmonic voltage per limb. Earthing of this winding then provides an earth screen for the EHV primary winding so equalising the stresses on the EHV insulation.

Figure 5:
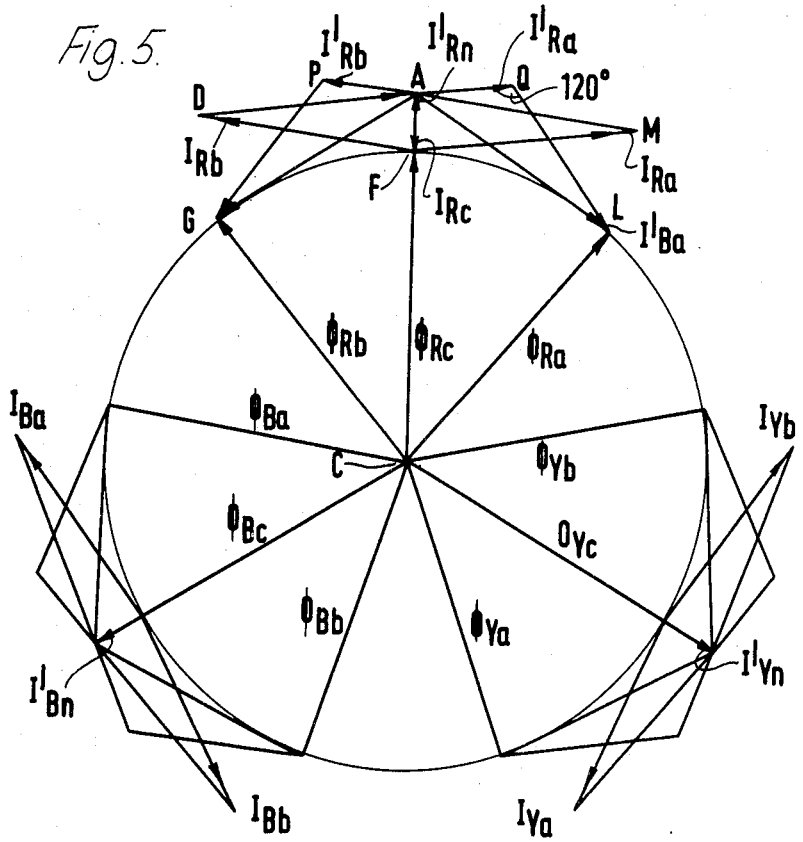
FIG. 5 is a vector diagram illustrating the operation of the reactor.

Referring now to FIG. 5, this explains the various currents and fluxes of the circuit of FIG. 4.

The primary fluxes of the three centre limbs $R_c$, $Y_c$ and $B_c$ are 120° apart and the 'a' and 'b' fluxes are shifted 40° on each side of these.

It may thus be seen that the nine limbs $R_a$, $R_b$ etc. have fluxes displaced by 40° successively and these fluxes are represented by the directions of the various radii of the inner circle shown.

The vector CA (the extent of which has to be determined) represents the ampere turns due to the red phase (R) of the primary winding 'p'. The Central windings 'c' of the phase-shifting windings are used as a turns reference to which al other ampere-turns are related, that is, all magnetising forces are represented by the current value that would give the same ampere-turns in a winding of $N_0$ turns. For example, if $I_{Rn}$ is the current in the primary winding $P_r$, then the current vector CA is drawn with a magnitude $I_{Rn} \cdot N_4/N_0 = I_{Rn}'$.

The magnetising force of the winding 'c' is represented directly by the magnitude of the current it carries, i.e. $I_{Rc}$, since the winding 'c' has the reference number of turns $N_0$. The current $I_{Rc}$ is in phase opposition to the primary current $I_{Rn}$ and is represented by the vector AF. The resultant magnetising force on the limb $R_c$ is therefore represented by CA-AF i.e. the vector CF which in turn represents a magnetising current designated $I_m$, in a 'standard' winding $N_0$.

From considerations of symmetry, the current $I_{Ra}$ in winding 'a' is equal in magnitude to the current $I_{Rb}$, and the resultant of these two is equal and opposite to the current $I_{Rc}$. $I_{Ra}$ is represented by vector FM and $I_{Rb}$ by vector FD.

The magnetizing force due to the phase-shifting windings on limb $R_a$ include a component AQ due to the current $I_{Ra}$ in winding 'a' and thus represented by a 'standardised' current $I_{Ra} \cdot N_2/N_0 = I_{Ra}'$, and a component QL due to the reverse current $I_{Ba}$ (identified by the 'a' winding of the B phase group) flowing in the $N_1$ winding on the $R_a$ limb. This component QL represents the 'standardised' current $-I_{Ba} \cdot N_1/N_0 = I_{Ba}'$.

The two currents $I_{Ra}$ and $I_{Ba}$ are in fact corresponding currents in different phase groups and the vectors AQ and LQ must therefore, for reasons of symmetry, be spaced at 120°.

The resultant of the currents AQ and QL on limb $R_a$ is AL which, on combination with the standardised primary current $I_{Rn}'$ (i.e. CA) gives a total resultant of CL. The flux in limb $R_a$ must therefore have this same phase, i.e. 40° displaced from the 'c' limb flux vector.

The $R_b$ limb must similarly have a flux represented (in direction) by the vector CG, being the resultant of current vectors AP ($I_{Rb} \cdot N_2/N_0$) and PG ($-I_{Yb} \cdot N_1/N_0$) on the limb and standardised primary current $I_{Rn}'$.

The three phase-sections of the vector diagram must of course be identical and it may be seen that the geometry of FIG. 5 is the only configuration permitted by the requirements that $I_{Ra} = I_{Rb}$; their vector summation $I_{Ra} + I_{Rb} = -I_{Rc}$; angle APG = angle AQL = 120°; and satisfying also the condition CG = CF = CL. It may be seen that the currents $I_{Ra}$ and $I_{Rb}$ are separated by a phase angle of 166.16°. The three phase shifting currents circulating through windings $N_0$, $N_1$ and $N_2$, are found to relate to the current $I_n$ in the ratios.

$$I_{Ra} = I_{Rb} = 0.6475\ I_{Rn}'$$

$$I_{Rc} = 0.156\ I_{Rn}'$$

As mentioned previously, the resulting standardised magnetising current for the limb $R_c$, i.e. $I_m$, represented by the vector CF, is equal to the standardised primary current $I_{Rn}'$ (CA) minus the current $I_{Rc}$ (AF). From the last equation above it may now be seen that $$I_m = I_{Rn}' - I_{Rc} = 0.844\ I_{Rn}'$$

This latter result, particularly, indicates a physically interesting effect of the flux-shifting windings, that is, that the magnetic stress on the iron core is reduced to a little over 5/6 the level that would be produced by the primary winding alone, the remaining 16% of the core flux being diverted by the winding on limb $R_c$ to the space between the phase shifting windings and the primary winding. The stress reduction factor is, in addition, independent of the current magnitude.

Figure 6:
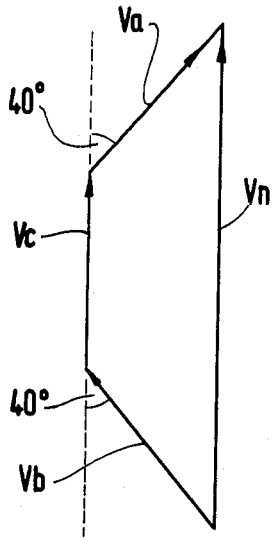
FIG. 6 is a voltage vector diagram for the fundamental in the primary winding as produced by the phase shifting windings of the reactor.

FIG. 6 shows a vector diagram for each primary winding, e.g. $P_r$, where $V_n$ is the applied phase to neutral voltage and $V_a$, $V_b$ and $V_c$ are the voltages induced in the primary winding by the fluxes in the three limbs 'a', 'b' and 'c' respectively. It will be seen that the resultant voltage is less than the arithmetic sum of the individual voltages, thus reducing the useful voltage of the reactor.

It will be seen from FIGS. 2 and 3 that the flux-shifting windings $N_0$, $N_1$ and $N_2$ extend right into the corners of the windows 5 between the limbs. As explained above, the flux-shifting windings reduce the magnetic stress on the core by opposing the primary ampere-turns. This is especially important at the limb extremities where in the absence of exciting ampere turns the unbalanced magnetic force of the saturated iron tends to cause a high leakage flux which is undesirable not only because it varies non-linearly with the reactor current but also tends to increase losses due to flux fringing at the transition into the yoke.

The unbalanced ampere turns at the limb extremities are compensated by using the $N_3$ winding as a flux shield in addition to its ninth-harmonic function described above. For this purpose the $N_3$ winding is connected in parallel sections as shown in FIG. 4, the paralleling connectors being fitted in the triangular spaces between the $N_1/N_2$, $N_0$ and $N_3$ windings.

However, with the FIG. 2 construction there is a problem with the much higher ampere turn pressure required in the corner section of the winding and this gives rise to cooling problems. These may be overcome by appropriately increasing the $N_3$ copper cross section.

In an alternative arrangement the windings are kept clear of the window corner and magnetic laminated iron fillets are inserted to relieve the magnetic stress. These may be secured by epoxy resin leaving just sufficient gaps for lamination insulation. The effect of these corner fillets is to reduce the saturated iron volume to the extent of the coils.

A further alternative for the relief of corner stresses is to carry the windings right into the corner of the window but to increase the yoke height and to notch out the yoke over the centre part of the width of the window, to give additional electrical clearance for the E.H.V. windings.

The problem of corner stresses will of course be much reduced if the E.H.V. winding is built as a multiple disk winding arranged in two parallel sections per limb which are connected and wound in such a way that all coils nearest the yoke may be earthed on one end to permit minimum clearance of the E.H.V. winding to the yoke.

The construction of the core as shown in FIG. 1 has certain disadvantages arising from excessive stressing of the insulation around the sharp corners of the circular segments of the 'a' and 'b' limbs. This may be alleviated by making the 'a' and 'b' limbs semi-circular, so avoiding the acute angles of FIG. 1, and making the cross section of the 'c' limb shorter and thicker. The composite leg then becomes oval in form.

A further modification of the structure as shown in FIGS. 1–4 may be desirable. It has been explained that the cross yokes CY bridging the normal yokes at the ends of each limb permit a 3-phase system of 3rd harmonic flux to circulate locally within each composite leg so cancelling any third harmonic voltage in the primary winding. The third harmonic balanced flux circuit can be provided entirely within each 3-limb core 'a', 'b' or 'c' (see FIG. 1) by shifting the windings cyclically downwards on the limbs of the Y and B composite legs, by one limb in the case of the Y leg and by two limbs in the case of the B leg. Each composite leg, therefore still has one of each type of winding *a, b* and *c*, and additionally, each core also has one of each type of winding *a, b* and *c*. Thus, in FIG. 4 the phase shifting windings are re-referenced 'b', 'a', 'c' on the Y composite leg and 'c', 'b', 'a' on the B leg, the 'a' limbs still being on the same 'a' core, as in FIG. 1, and the 'b' and 'c' limbs similarly. It may then be seen that the three limbs of each core have fundamental fluxes spaced at ± 160, their third harmonic fluxes therefore being spaced at 120° and thus forming a closed triangle. No cross yokes CY are therefore necessary, the basic yokes, increased in height slightly, completing the third harmonic circuits.

There is, however, a disadvantage, because the main fluxes in the three limbs of each core are now spaced at only ± 160 and therefore can no longer produce a closed triangle. A return limb between the two yokes is therefore necessary at one or both ends of the core for instance.

A similar effect can be achieved by cycling the *a, b* and *c* windings upwards, in effect interchanging the Y and B limb windings. In this case the fundamental fluxes are spaced at 80° and still do not form a closed triangle.

In FIG. 1, the neutral terminals *u, v* and *w* provide a third harmonic three-phase voltage system. In the comparable treble tripler reactor referred to above, a saturating mesh reactor is connected to selected terminals of the symmetrical mesh winding at which a symmetrical 3-phase third harmonic voltage is obtained to provide a second stage of harmonic compensation.

The internal compensation of harmonics in the treble tripler reactor involves two principles: first, the cancellation of harmonics in a symmetrical polyphase system of non-linear elements. As explained above, this extends only up to, but not including, the harmonic $2n-1$, where $n$ is the number of limbs. The next two harmonics $2n\pm1$ are suppressed in the treble-tripler by the above mentioned saturating mesh reactor.

This second stage compensation proved necessary in the treble tripler because the total series connection of all windings per phase produces a relatively high amplitude of the residue harmonics $2n\pm1$. In contrast, a parallel connection of the windings exciting different phase displaced groups of limbs causes much less of these higher harmonics but a reduced linearity of the resulting characteristic of the reactor.

The cause of the poorer shape of the characteristic was found to be the sinusoidal shape of the flux wave resulting from paralleled windings if at the same time the third harmonic was completely suppressed by means of mesh windings. Such mesh windings would be necessary if the reactor was to be earthed at its neutral.

The present scheme solves this problem by a compromise which, at least in some circumstances, makes the second stage harmonic compensation unnecessary; the series connection of the primary windings (to which a common winding surounding several cores is physically equivalent) is retained but in conjunction with a parallel connection of the flux shifting ampere-turns in a system of nine-phase symmetry.

In the event that, due to special circumstances, some degree of the above second stage of harmonic compensation is necessary, three mesh connected single-phase saturated reactors are connected to the terminals *u, v* and *w*. Although only 3rd harmonic voltages appear at *u, v* and *w* they are in this case not symmetrical on account of the differences in the effective winding factors for the third harmonics in the groups *a, b* and *c* involved. This prevents the adoption of a symmetrical 3-phase mesh reactor as in the treble tripler.

For very large reactors the permissible weight and profile may make the construction of reactors in accordance with FIGS. 1–3 uneconomical if two or more of them have to be used. In such a case three single-phase units may be preferable. Each unit would consist of two composite legs each similar to that of FIG. 3, the corresponding limbs of the two legs being connected by respective yokes. Alternatively, this may be considered as a single window version of FIG. 2 although cross yokes CY would not then be required. The primary winding would be wound in opposite directions on the two limbs and connected in parallel so as to produce a circulating flux in each of the three two limb cores. The relief of corner stresses is achieved by notching out the yoke as mentioned for the construction of FIG. 2. In addition, the primary windings have voltage-graded winding layers, which may also of course be applied to the illustrated construction.

Figure 7:
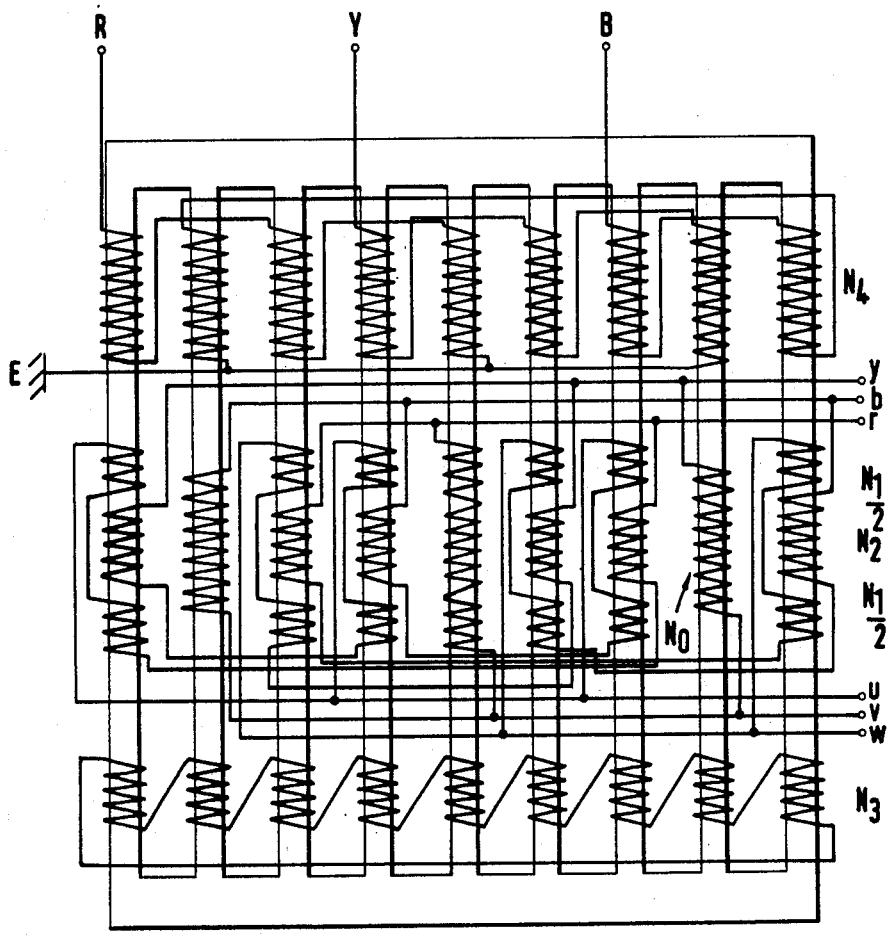
FIG. 7 is an alternative reactor construction based on a known treble-tripler reactor.

An alternative use of the principles entailed in the reactor transformer so far described may be made in a construction more resembling a treble tripler reactor and likewise not suited to avoid the need for an EHT transformer. This is shown in FIG 7. In this case the limbs are not grouped in threes but are regularly spaced in the same plane between two yokes. The same winding principles apply, however. The primary winding for each phase consists of three coils in series on respective limbs this being equivalent to a single coil embracing three limbs as in FIG. 1. Thus the R-phase coils are wound on limbs 1, 3 and 5, the Y-phase coils on limbs 4, 6 and 8, and the B-phase coils on limbs 7, 9 and 2. The remote ends of these windings are commoned to provide an earth star-point terminal.

The phase-shifting windings have the same parallel connection pattern as those in FIG. 4 but the order is re-arranged to obtain maximum flux balance in the yokes. Thus, successive limbs have flux phases spaced either all at 160° or all at 200°. The three R-phase limbs 1, 3 and 5 therefore have phase spacings of 2 × 160 (or 200), i.e. 40°. Similarly the Y-phase limbs 4, 6 and 8 are spaced at 40° and the B-phase limbs 7, 9 and 2 also. The limbs 5, 8 and 2 with the reference windings $N_0$ are, as before, aligned with the R, Y and B phases respectively, and therefore the limb fluxes span 360° at 40° spacing.

The $N_3$ winding in FIG. 7 is also shown modified from that in FIG. 4. It is assumed that in this case the $N_3$ winding is nearest the limb and cannot consequently provide an earth shield between the primary and the phase-shifting windings. Neither does it form a flux shield and its coils are therefore entirely in series and arranged with the shortest possible interconnections. It could however be wound analogously to the arrangement of FIG. 4.

Any of the described arrangements offer a selection of supply voltages. In FIG. 1 the terminals $r_1$, $y_1$ and $b_1$ could be used for local supply or distribution purposes and the terminals $r_2$, $y_2$ and $b_2$ for synthetic testing requirements.

In the case of FIG. 7 it is preferable not to bring out the terminals *u, v* and *w*. If then it is found desirable to use a saturating mesh reactor to suppress the 17th and 19th primary current harmonics this can be connected to symmetrical mesh connections on the $N_3$ winding in this way known for the treble tripler reactor.

An additional advantage of the earthed star-point EHV winding, in those described arrangements which involve a common primary winding embracing three of the nine fluxes each, is that it lends itself particularly to the application of tap-changers directly on the neutral of this winding. This is not possible in the arrangement shown in FIG. 7. This arrangement does, however, allow direct star point earthing as its main advantage over the treble tripler reactor as described in British Pat. Specification No. 1303634. It may be compared with the features of the arrangements proposed in U.S. Pat. No. 4,058,761.

In all cases the $N_1$ winding is preferably split into two portions, each of $N_1/2$ turns, which are separated by the $N_2$ winding. In this way the two windings embrace the same total flux area more nearly than with the FIG. 4 arrangement. This is important on account of the parallel connection involved for these windings.

I claim:

1. A saturated reactor arrangement for use in a voltage stabilising system, the reactor arrangement comprising a reactor core having nine wound limbs, a symmetrical star-connected primary winding distributed over said nine wound limbs, a set of phase-shifting windings arranged on said nine limbs and interconnected to produce fluxes in the nine limbs of phases uniformly staggered throughout 360°, each arm of said primary star-connected winding embracing three of said nine limbs whose flux phases are such as to provide net cancellation of third harmonic voltages in that arm, and a mesh-connected winding coupling said nine limbs to provide a path for the circulation of ninth harmonic current, and a terminal connection for earthing the star point of said primary winding.

2. A reactor arrangement according to claim 1, constituting a combined transformer and voltage stabilising reactor for direct connection to an EHV power system.

3. A reactor arrangement according to claim 1, wherein said nine limbs are arranged in groups of three, each group forming one composite leg of a 3-leg reactor, and said primary winding comprising a coil on each said composite leg embracing all three limbs.

4. A reactor arrangement according to claim 3, wherein said mesh connected winding also comprises a coil on each said composite leg embracing all three limbs.

5. A reactor arrangement according to claim 3, including three magnetic circuits each comprising three of said limbs, one limb from each of said composite legs, and two yokes.

6. A reactor arrangement according to claim 5, wherein the three limbs of each magnetic circuit carry fluxes phase displaced by 120°, and a transverse yoke at both ends of each composite leg bridging the limbs within that composite leg to permit the circulation of third harmonic flux.

7. A reactor arrangement according to claim 5, wherein the three limbs of each magnetic circuit carry fluxes phase displaced, to provide a balanced third harmonic system within each said magnetic circuit, at least one unwound return limbs being provided between the yokes in each said magnetic circuit to carry the resulting net fundamental flux.

8. A reactor arrangement according to claim 1 wherein said mesh connected winding physically separates said primary winding from said phase-shifting windings to provide an earth shield for said primary winding.

9. A reactor arrangement according to claim 1, and comprising nine limbs, similarly disposed between two yokes, said primary winding comprising, for each of the star connected arms, a coil on each of three limbs, connected in series.

10. A reactor arrangement according to claim 9, wherein said phase-shifting windings are disposed throughout the nine limbs in such manner that adjacent limbs have flux phases spaced all at 160° or all at 200°, the three coils of each said star-connected arm being disposed on alternate ones of the nine limbs so that said alternate limbs have fluxes spaced at 40°, the three primary windings being staggered symmetrically throughout the nine limbs.

* * * * *